US008052552B2

(12) United States Patent
Silverglate

(10) Patent No.: US 8,052,552 B2
(45) Date of Patent: Nov. 8, 2011

(54) TOY APPARATUS WITH RATTLE

(75) Inventor: David E. Silverglate, Santa Cruz, CA (US)

(73) Assignee: Got I, LLC, Alpharetta, GA (US)

( * ) Notice: Subject to any disclaimer, the term of this patent is extended or adjusted under 35 U.S.C. 154(b) by 269 days.

(21) Appl. No.: 12/347,323

(22) Filed: Dec. 31, 2008

(65) Prior Publication Data

US 2009/0170646 A1 Jul. 2, 2009

Related U.S. Application Data

(60) Provisional application No. 61/018,472, filed on Jan. 1, 2008.

(51) Int. Cl.
*A63B 43/00* (2006.01)

(52) U.S. Cl. ..... 473/571; 473/594; 473/612; 446/419

(58) Field of Classification Search ..... 473/571, 473/570, 594, 577, 612; 446/418, 419, 404; 119/707; D21/406, 408
See application file for complete search history.

(56) References Cited

U.S. PATENT DOCUMENTS

| | | | | | |
|---|---|---|---|---|---|
| 2,211,102 | A | * | 8/1940 | Davis | 446/419 |
| 2,499,483 | A | * | 3/1950 | Foy | 473/594 |
| 2,687,302 | A | * | 8/1954 | Stiegler | 473/571 |
| 2,717,473 | A | * | 9/1955 | Moore | 473/571 |
| 3,046,016 | A | | 7/1962 | Laws | |
| 3,603,023 | A | * | 9/1971 | McHugh | 446/431 |
| 3,633,587 | A | * | 1/1972 | Hunt | 473/594 |
| 3,691,704 | A | | 9/1972 | Novak | |
| 3,889,950 | A | | 6/1975 | Kasravi | |
| 3,959,937 | A | | 6/1976 | Spunt | |
| 4,309,852 | A | | 1/1982 | Stolpin | |
| 4,637,941 | A | | 1/1987 | Rochte | |
| 4,645,471 | A | * | 2/1987 | Herring et al. | 446/409 |
| 4,778,429 | A | * | 10/1988 | Todokoro | 446/153 |
| 4,813,674 | A | | 3/1989 | Lorhpipat | |
| 4,836,787 | A | | 6/1989 | Boo | |
| 5,104,125 | A | | 4/1992 | Wilson | |
| D336,317 | S | * | 6/1993 | Thomson et al. | D21/468 |
| 5,219,162 | A | * | 6/1993 | Orbanes et al. | 473/571 |
| 5,224,959 | A | | 7/1993 | Kasper | |
| 5,236,196 | A | | 8/1993 | Blankenburg et al. | |
| 5,309,586 | A | * | 5/1994 | Sies et al. | 446/404 |

(Continued)

OTHER PUBLICATIONS

ISA Korean Intellectual Property Office, International Search Report of PCT/US2010/055855, Jul. 27, 2011, 9 pages.

*Primary Examiner* — Steven Wong
(74) *Attorney, Agent, or Firm* — Alleman Hall McCoy Russell & Tuttle LLP

(57) ABSTRACT

A toy apparatus having a surface is provided. The toy apparatus may include a mesh including a plurality of loop structures having cooperative mating surfaces disposed at least partially around an outer perimeter of each loop structure. The plurality of loop structures may have curved inside perimeter surfaces, and the cooperative mating surfaces of adjacent loop structures may be configured to couple together for a distance along their lengths. The loop structures form the surface of the toy when the cooperative mating surfaces are coupled with each other. The toy apparatus may further include a rattle positioned in a loop structure in the mesh, the rattle having a body with a mounting structure having an outer perimeter sized to conform to the curved inside perimeter surface of the loop structure in which the rattle is mounted.

18 Claims, 2 Drawing Sheets

U.S. PATENT DOCUMENTS

| | | | | |
|---|---|---|---|---|
| 5,411,262 | A | 5/1995 | Smith | |
| D366,288 | S * | 1/1996 | Kino | D21/406 |
| 5,611,721 | A * | 3/1997 | Hoeting et al. | 446/419 |
| 6,418,673 | B1 | 7/2002 | Flowerday | |
| 6,729,984 | B2 | 5/2004 | Silverglate | |
| D563,609 | S * | 3/2008 | Gick et al. | D30/160 |
| 7,867,115 | B2 * | 1/2011 | Zawitz | 473/570 |
| 2009/0170643 | A1 | 7/2009 | Silverglate | |
| 2009/0170646 | A1 | 7/2009 | Silvergate | |

* cited by examiner

TOY APPARATUS WITH RATTLE

CROSS REFERENCE TO RELATED APPLICATION

This application claims priority under 35 U.S.C. §119 to U.S. provisional patent application, Ser. No. 61/018,472, entitled TOY APPARATUS INCLUDING A MESH, filed on Jan. 1, 2008, the entire disclosure of which is herein incorporated by reference.

BACKGROUND

Balls are one of the oldest forms of toys and sports equipment, and many popular games today still involve rolling, passing, kicking, tossing, catching, bouncing, or hitting balls. Other toys may have similar play patterns as balls, and both balls and other toys may have smooth surfaces. Children and young adults and are also drawn to toys that can be accessorized with characters or other accessories that give the ball visual, acoustic and tactile interest. However, conventional balls and other toys having a smooth surface are not always suitable for attaching accessories, and can be difficult to grasp for some users, especially small children and infants.

SUMMARY

A toy apparatus having a surface is provided. The toy apparatus may include a mesh including a plurality of loop structures having cooperative mating surfaces disposed at least partially around an outer perimeter of each loop structure. The plurality of loop structures may have curved inside perimeter surfaces, and the cooperative mating surfaces of adjacent loop structures may be configured to couple together for a distance along their lengths. The loop structures form the surface of the toy when the cooperative mating surfaces are coupled with each other. The toy apparatus may further include a rattle positioned in a loop structure in the mesh, the rattle having a body with a mounting structure having an outer perimeter sized to conform to the curved inside perimeter surface of the loop structure in which the rattle is mounted. In some aspects, the mesh of the toy apparatus may be formed in the shape of a ball or other object that encloses a void. In other aspects, the mesh of the toy apparatus may not enclose a void.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The toy apparatus of the present disclosure may include a mesh of the form described in U.S. Pat. No. 6,729,984, entitled TOY BALL APPARATUS, which issued May 4, 2004, the entire disclosure of which is hereby incorporated by reference.

Figure 1:
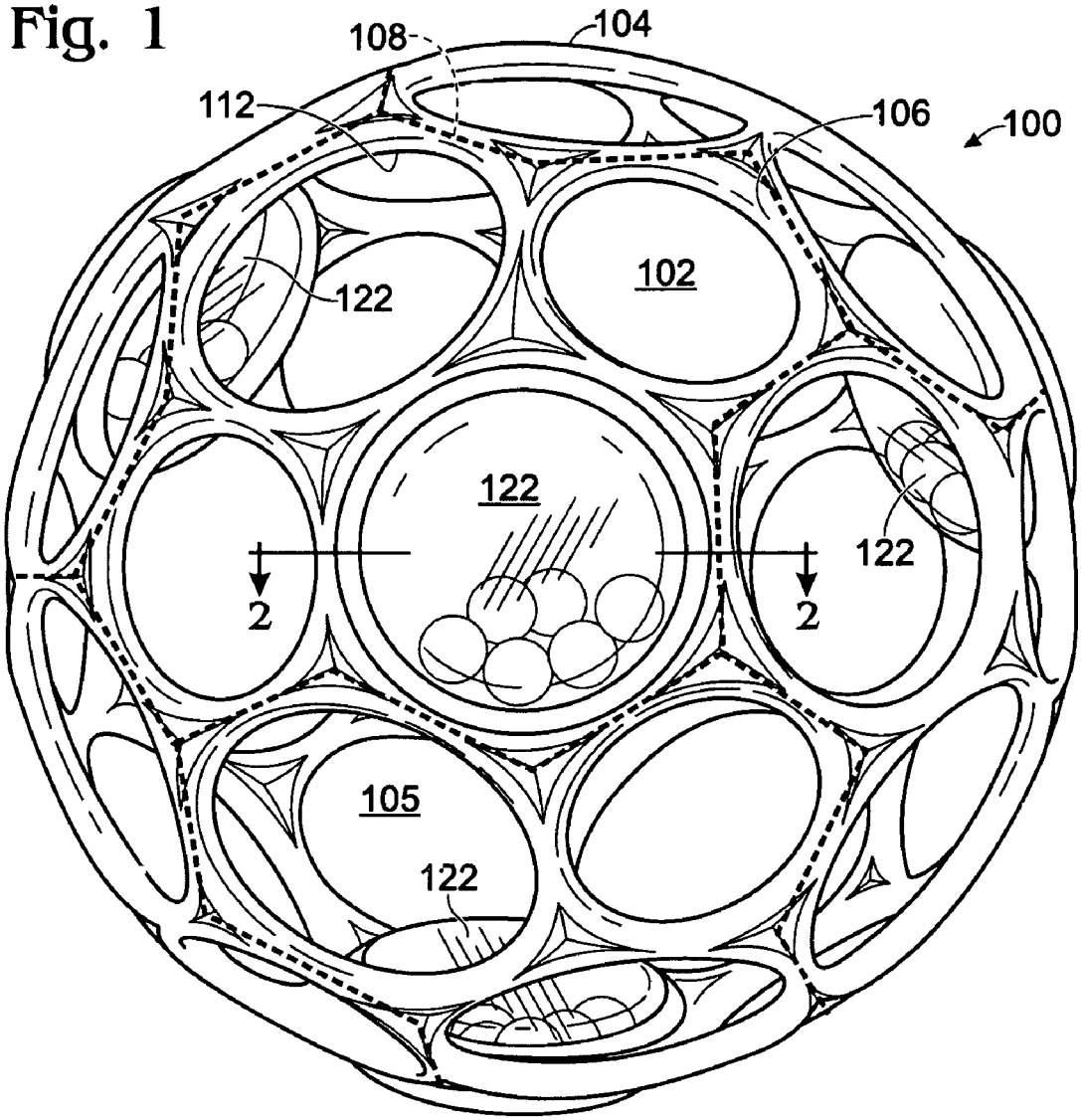
FIG. 1 is a front perspective view of a first embodiment of a toy apparatus formed from a resiliently deformable mesh of loop structures to be in the shape of a ball, and including a plurality of rattles inserted in respective loop structures of the mesh.

As illustrated in FIG. 1, a toy apparatus 100 is provided that has a surface 102 defined by a mesh 104. The mesh 104 typically includes a plurality of loop structures 106 having cooperative mating surfaces 108 disposed at least partially around an outer perimeter of each loop structure 106. The plurality of loop structures 106 have curved inside perimeter surfaces 112. The cooperative mating surfaces 108 of adjacent loop structures 106 are configured to couple together for a distance along their lengths. The loop structures 106 form the surface 102 of the toy when the cooperative mating surfaces are coupled with each other. It will be appreciated that such a mesh 104 of loop structures 106 with curved inner perimeter surfaces 112 may easily be grasped, even by the reflex action of an infant's grasping hands.

Figure 2:
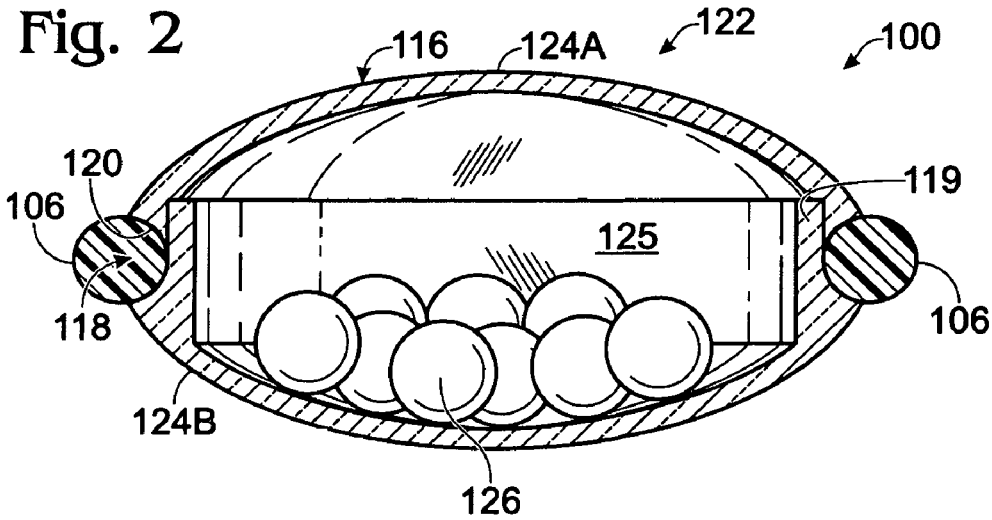
FIG. 2 is a cross-sectional view of one of the rattles of FIG. 1.

As shown in FIG. 2, the toy apparatus 100 may also include one or more rattles 122 positioned in a loop structure 106 in the mesh 104, each rattle 122 having a body 116 with a mounting structure 118 having an outer perimeter 120 sized to conform to the curved inside perimeter surface 112 of the loop structure 106 in which the rattle 122 is mounted. In the embodiment illustrated in FIG. 1, the mesh 104 is formed in the shape of a ball enclosing a void 105, and the plurality of rattles 122 are positioned at symmetric locations in the mesh 104. Although various numbers of rattles 122 may be provided, in the depicted embodiment of FIG. 1, four rattles 122 are provided. It will be appreciated that symmetric mounting of the rattles 122 around the spherical surface of the ball shaped mesh 104, ensures that the center of gravity of the ball with the rattles 122 mounted is near the geometric center of the ball, which in turn facilitates smooth, predictable movement of the ball when rolled or thrown. Thus, it will be appreciated that various numbers of the plurality of loop structures 106 may have rattles 122 positioned therein, and the other loop structures 106 of the plurality of loop structures 106 have curved inside perimeter surfaces 112 defining curved finger-receiving voids in the surface of the toy apparatus such that a user's fingers may extend through the loop structures 106, and grasp two or more of the loop structures 106 in a gripping motion to secure a grip on the mesh.

Figure 3:
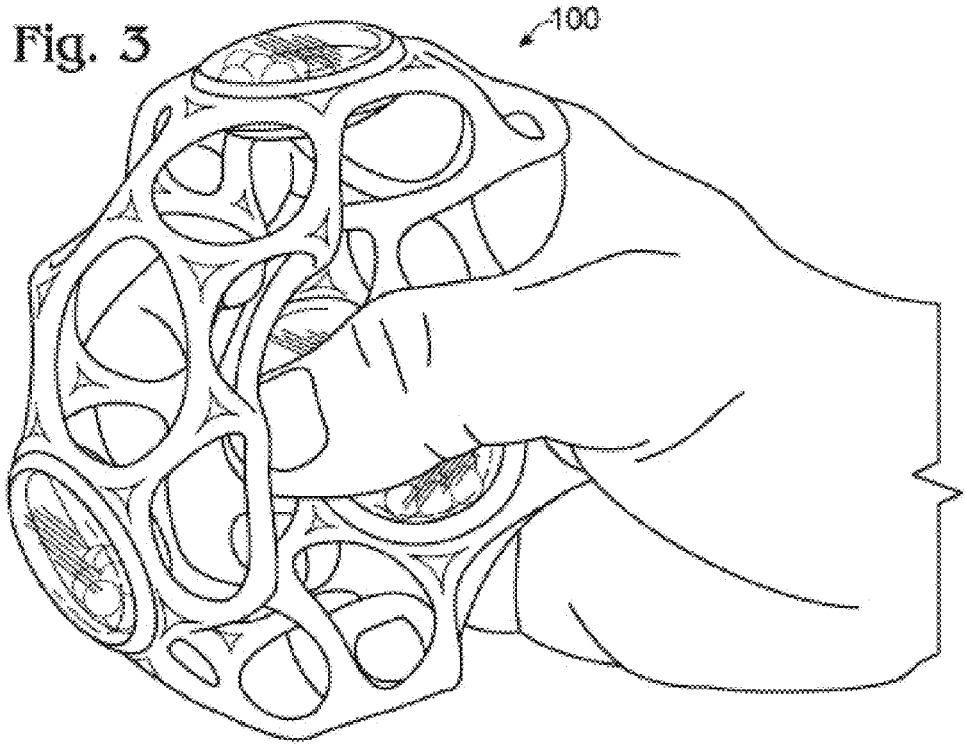
FIG. 3 is a perspective view of the toy apparatus of FIG. 1, temporarily crushed by the hand of a user.

In the embodiment illustrated in FIG. 1, the mesh 104 is formed as a resiliently deformable ball, which facilitates tossing, bouncing, catching and other forms of play. As illustrated in FIG. 3, the ball may be crushed by the hand of a user, such as a child, and typically springs back to its original size, which provides spring to the ball when hit or kicked, and promotes safe play.

As illustrated in FIG. 2, the body of the rattle is divided into two halves, a bottom half 124B and a top half 124A, each of which is domed outward, the top half and bottom half defining a central void 125. As viewed from above in FIG. 1, the outer perimeter 120 of mounting structure 118 is circular, and the inside perimeter surface 112 of the loop structure 106 of the mesh in which each rattle 122 is mounted, is circular. As viewed in cross section in FIG. 2, the outer perimeter 120 of mounting structure 118 has a concave radius formed in the edge thereof, to accommodate a round cross section of the loop structure 106. The top half 124A and bottom half 124B are typically joined to each other in an interior of the loop structure 106, being adhered to each other along a seam 119 in the vicinity of the mounting structure 118. Thus, as can be seen from FIG. 2, portions of the top half and bottom half form the mounting structure 118. In one embodiment, the mounting structure is plastically welded to the insider perimeter surface 112 of the loop structure of the mesh, although adhesives or other joining techniques may be used.

It will be appreciated that the body 116 of each rattle 122 may be substantially watertight, and may provide buoyancy to the to apparatus 100, enabling it to float in water, which may be advantageous. Further, the domed shape construction of the top half 124A and bottom half 124B provide strength to the rattles 122. Further, since the domed shape is usually of a relatively low profile, the top half 124A does not extend outward from the surface 102 of the toy apparatus 100 to an extent that inhibits rolling of the toy apparatus in the embodiment of FIG. 1.

As can be seen in FIG. 1, the bottom half 124B and top half 124A of the rattle 122 are transparent or at least partially transparent, and objects such as balls 126 that are positioned within the void 114 can be seen through the transparent halves that form the body 116. A variety of materials may be used for the transparent halves of the body 116, such as acrylic or polycarbonate. In some embodiments, the balls 126 may be of various colors to provide visual contrast and enjoyment for users. Further, when shaken or otherwise disturbed, the balls 126 colliding with each other and the body 116 of the rattle 122 produce a noise that is pleasing.

Figure 4:
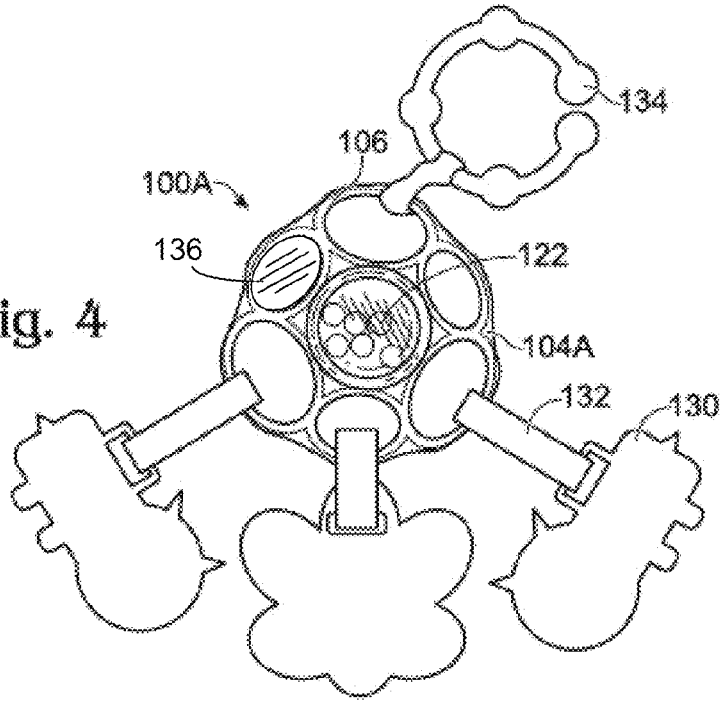
FIG. 4 illustrates a second embodiment of a toy apparatus according to the subject invention, in the form of a mesh of loop structures with a rattle assembly inserted into a loop structure of the mesh, the mesh being formed so as not to enclose a void.

As illustrated in FIG. 4, a second embodiment of a toy apparatus 100A is illustrated. Toy apparatus 100A includes a mesh 104A formed of loop structures 106 as described above. Mesh 104A forms a surface that does not enclose a void. One or more rattles 122 as described above may be provided in loop structures of the mesh 104A. Further, one or more accessories 130 may be connected with the mesh 104A. Each accessory 130 may be connected with a rim of a loop structure of the mesh by a fastener, for example, such as a short belt 132. A clip 134 may be used to attach the toy apparatus 100A to an object such as a high chair, car seat, stroller, etc., to prevent loss and give a child the ability to continue play in these environments. The accessories 130 may be in a wide variety of shapes and sizes. For example, the accessories 130 may be in the form of teething rings, character shapes, etc., making the toy apparatus 100A suitable for use by small children and infants. The accessories 130 may also be in the form of a disc 136, on which indicia are provided, or to which a structure such as an ornament may be mounted.

The above described embodiments provide a toy apparatus that is easily graspable, even by the small hands of infants and toddlers, due to its mesh with loop structures, and that provides sound and visual stimulation to users when shaken through its rattles mounted in the loop structures.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A toy apparatus having a surface, the toy apparatus comprising:

a mesh including a plurality of loop structures having cooperative mating surfaces disposed at least partially around an outer perimeter of each loop structure, wherein the plurality of loop structures have curved inside perimeter surfaces, and wherein the cooperative mating surfaces of adjacent loop structures are configured to couple together for a distance along their lengths, wherein the loop structures form the surface of the toy apparatus when the cooperative mating surfaces are coupled with each other, and wherein the mesh is formed as a resiliently deformable ball; and a rattle positioned in at least one of the loop structures in the mesh, the rattle having a body with a mounting structure having an outer perimeter sized to conform to the curved inside perimeter surface of the loop structure in which the rattle is mounted, other loop structures of the plurality of loop structures having curved inside perimeter surfaces defining curved finger-receiving voids in the surface of the toy apparatus.

2. The toy apparatus of claim 1, wherein the outer perimeter of the mounting structure is circular, and wherein the inside perimeter surface of the loop structure in which the rattle is mounted is circular.

3. The toy apparatus of claim 2, wherein the outer perimeter of the mounting structure has a concave radius formed in an edge thereof, as viewed in cross section, to accommodate a round cross section of the loop structure in which the rattle is mounted.

4. The toy apparatus of claim 3, wherein the body of the rattle includes a bottom half and a top half, each of which is domed outward, the top half and bottom half defining a central void.

5. The toy apparatus of claim 4, wherein each of the top half and bottom half of the body of the rattle are joined to each other in an interior of the loop structure in which the rattle is mounted.

6. The toy apparatus of claim 5, wherein the top half and bottom half are adhered to each other.

7. The toy apparatus of claim 4, wherein the bottom half and top half of the body are at least partially transparent.

8. The toy apparatus of claim 4, wherein objects are positioned within the void defined by the top half and the bottom half.

9. The toy apparatus of claim 4, wherein the mounting structure is plastically welded to the inside perimeter surface of the loop structure in which the rattle is mounted.

10. The toy apparatus of claim 1, wherein the rattle is one of a plurality of rattles positioned in corresponding loop structures of the mesh.

11. The toy apparatus of claim 10, wherein the plurality of rattles are positioned at symmetric locations in the mesh.

12. A toy apparatus comprising:

a mesh including a plurality of loop structures having curved inside perimeter surfaces, wherein the mesh is formed as a resiliently deformable ball; and a rattle positioned in one of the loop structures in the mesh, the rattle having a body formed of a bottom half and a top half defining a void, one or more objects being positioned within the void, the body further including a mounting structure formed by portions of one or more of the top half and bottom half, the mounting structure having an outer perimeter edge with a concave radius formed therein, as viewed in cross section, the radius of the edge being sized to conform to the curved inside perimeter surface of the loop structure in which the rattle is mounted.

13. The toy apparatus of claim 12, wherein the outer perimeter edge of the mounting structure is circular, and wherein the inside perimeter surface of the loop structure in which the rattle is mounted is circular.

14. The toy apparatus of claim 13, wherein the bottom half and top half of the body are at least partially transparent.

15. The toy apparatus of claim 12, wherein the objects positioned in the void of the rattle are balls; and wherein the balls are positioned within the void defined by the top half and the bottom half.

16. The toy apparatus of claim 12, wherein the mounting structure is plastically welded to the inside perimeter surface of the loop structure in which the rattle is mounted.

17. The toy apparatus of claim 12, wherein the rattle is one of a plurality of rattles positioned in corresponding loop structures of the mesh, and the plurality of rattles are positioned at symmetric locations in the mesh.

18. The toy apparatus of claim 12, further comprising:

an accessory connected with the mesh, wherein the accessory is connected with a rim of a loop structure of the mesh.

* * * * *